US008497443B2

(12) United States Patent
Shimizu

(10) Patent No.: US 8,497,443 B2
(45) Date of Patent: Jul. 30, 2013

(54) SWITCH ACTUATION DEVICE, INTERLOCK SYSTEM, AND IMAGE FORMING APPARATUS INCORPORATING SWITCH ACTUATION DEVICE

(75) Inventor: Keisuke Shimizu, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 137 days.

(21) Appl. No.: 13/064,013

(22) Filed: Mar. 2, 2011

(65) Prior Publication Data

US 2011/0214972 A1 Sep. 8, 2011

(30) Foreign Application Priority Data

Mar. 4, 2010 (JP) ..... 2010-047358

(51) Int. Cl.
*H01H 3/04* (2006.01)
*H01H 3/20* (2006.01)

(52) U.S. Cl.
USPC ..... 200/335

(58) Field of Classification Search
USPC ..... 200/335, 332, 329, 4, 43.07, 43.08, 200/50.03, 50.05, 50.06, 43.16, 61.62, 61.61, 200/528, 533, 542, 557, 558, 570, 573, 321, 200/320, 318
See application file for complete search history.

(56) References Cited

U.S. PATENT DOCUMENTS 4,663,505 A * 5/1987 Drake ..... 219/722
2007/0059036 A1 3/2007 Yamada et al.
2007/0196152 A1 8/2007 Shimizu et al.
2008/0025751 A1 1/2008 Andoh et al.
2008/0257700 A1* 10/2008 Bacigalupe et al. ..... 200/329
2010/0054791 A1 3/2010 Shimizu

FOREIGN PATENT DOCUMENTS

CN 1089388 A 7/1994
JP 05165267 A 7/1993
JP 2008037054 A 2/2008
JP 2009037997 A 2/2009
WO WO 2008052702 A1 * 5/2008

OTHER PUBLICATIONS

Chinese Office Action for corresponding application dated Mar. 19, 2013.

* cited by examiner

*Primary Examiner* — Edwin A. Leon
*Assistant Examiner* — Anthony R Jimenez
(74) *Attorney, Agent, or Firm* — Harness, Dickey & Pierce

(57) ABSTRACT

A switch actuation device for turning on and off a switch in accordance with one of movement and rotation of at least two movable members. The switch actuation device includes a first shaft, a supporting member, a second shaft, and a swingable lever. The swingable lever is supported by the second shaft with its both ends being swingable, one of said both ends including a switch actuation section activating the switch. The switch actuation section of the swingable lever activates the switch when the supporting member and the swingable lever swing at the same time in response to the movement or the rotation of the first and second one of the at least two movable members, respectively. The switch actuation section of the swingable lever includes a cam.

14 Claims, 6 Drawing Sheets

SWITCH ACTUATION DEVICE, INTERLOCK SYSTEM, AND IMAGE FORMING APPARATUS INCORPORATING SWITCH ACTUATION DEVICE

CROSS REFERENCE TO RELATED APPLICATIONS

This application claims priority pursuant to 35 USC §119 to Japanese Patent Application No. 2010-047358, filed on Mar. 4, 2010, the entire contents of which are hereby incorporated by reference herein.

BACKGROUND OF THE INVENTION

1. Field of the Invention

The present invention relates to a switch actuation device that turns on and off a switch in accordance with movement or rotation of plural movable members, and an interlock mechanism and an image forming apparatus, such as a copier, a facsimile apparatus, a printer, etc., incorporating the switch actuation device.

2. Description of the Background Art

A conventional interlock mechanism includes a switch that operates in accordance with opening and closing of a wall cover constituting a housing of an electronic instrument is known. Also known is that power supply and general control are stopped when the wall cover is opened and the switch is turned off.

Such an interlock mechanism is also employed in an image forming apparatus, such as a copier, a facsimile apparatus, a printer, etc. For example, an interlock mechanism is used to control a switch actuation device to turn off a switch and stop supplying power in an image forming apparatus when a part of an openably closable housing is opened during maintenance, such as removing a jammed sheet, replenishing toner, replacing a process unit with a new one, etc. When an image forming apparatus includes plural openably closable covers, plural switch actuation devices are sometimes employed corresponding thereto to maintain the image forming apparatus by opening and closing one of the plural covers. However, a number of switch actuation devices increases as a result.

Japanese Patent Application Laid Open No. H05-165267 (JP-H05-165267-A) describes an image forming apparatus that includes an actuation lever that moves to an actuation position to actuate a switch in accordance with opening and closing of a first cover, and a movable lever that moves the actuation lever to the actuation position to actuate the switch in accordance with opening and closing of a second cover. Consequently, by combining the first actuation lever with the second movable lever, a power supply can be turned on and off in accordance with opening and closing of plural covers.

However, in the image forming apparatus of the JP-H05-165267-A, due to fluctuation in positions or shapes of a pressing member provided on a cover to press and activate the actuation and movable levers or of the levers themselves, the switch does not operate sometimes even when the cover is closed. Otherwise, the switch is possibly damaged or deformed when the cover is closed and the actuation lever excessively presses the actuation lever simultaneously.

Japanese Patent Application Laid Open No. 2008-37054 (JP-2008-37054-A) describes an interlock mechanism that employs a switch turned on when a switch actuation element is internally depressed against a bias force of a spring provided inside a switch housing. Such an interlock mechanism employs plural members to differentiate a direction in which a switch actuation element is turned on from that in which an openably closable cover moves when being closed. Owing to such a configuration of the differentiation mechanism, a force of a cover is indirectly conveyed to the switch actuation element and is not directly conveyed to the switch actuation element from the cover. Accordingly, the switch can avoid damage, even when subjected to a force more powerful than expected when the cover is closed.

However, the switch is overloaded depending on fluctuation in positions of a pressing member pressing the switch actuation element and shapes thereof in the interlock mechanism of JP-2008-37054-A.

As a configuration capable of obtaining stable actuation regardless of fluctuation in closing and opening and movement amounts of plural covers, Japanese Patent Application Laid-Open No. 2009-37997(JP-2009-37997-A) proposes a switch actuation device that includes a first swingable lever and a second lever pivotally supported by a support shaft provided on the first lever serving as a fulcrum at its middle portion with its one end facing the switch. The switch actuation device further includes a first actuation section that causes a second lever to swing toward a switch in accordance with opening and closing of one of two openably closable covers. Further included is a second actuation section that causes the first lever to swing in accordance with opening and closing of the other one of the two openably closable covers. Thus, when the other one of the two openably closable cover is closed, the second actuation section swings the first lever and causes the second lever to approach an actuator of a switch. Further, when one of the two openably closable covers is closed, the first actuation section makes one of swinging ends of the second lever to swing toward an actuator of a switch, and causes one of swinging ends of the second lever to press and move the actuator, and turn on the switch. With such a switch actuation device, even when amounts of opening and closing and movement fluctuate, a mutual positional relation between the first and second actuation sections and the first and second levers can be stably maintained by forming the first and second actuation sections in a cam shape. As a result, contact positions between the first and second actuation sections and the first and second levers can be substantially the same, respectively, so that a stable operation can be obtained.

However, in the switch actuation device of JP-2009-37997-A, depending on and owing to fluctuation in positions and shapes of the second lever that directly contacts the switch, the switch is susceptible to being, overloaded.

SUMMARY OF THE PRESENT INVENTION

The present invention has been made in view of the above noted and another problems and one object of the present invention is to provide a new and novel switch actuation device. Such a switch actuation device comprises a first shaft, a supporting member swingably or rotatably supported around the first shaft in response to movement or rotation of a first movable member, a second shaft disposed in the supporting member. A swingable lever is supported by the second shaft with its both ends being swingable in response to movement or rotation of a second movable member. One of these ends includes a switch actuation section activating the switch. The switch actuation section of the swingable lever activates the switch when the supporting member and the swingable lever swing at the same time in response to the movement or the rotation of the first and second movable members, respectively. The switch actuation section of the swingable lever includes a cam.

In another aspect, the cam includes an arc shaped portion disposed facing the switch.

In yet another aspect, a third shaft is disposed and an actuation member is swingably or rotatably supported therearound. The actuation member presses an actuation object section positioned opposite to the switch actuation section of the swingable lever. The actuation member swings or rotates in response to the movement or the rotation of the second movable member and presses the actuation object section of the swingable lever in a prescribed direction to finally activate the switch.

In yet another aspect, the actuation member includes a cam at its one end pressing the actuation object section of the swingable lever.

In yet another aspect, the cam includes an arc-shaped portion facing the actuation object section of the swingable lever.

In yet another aspect, a first biasing member is provided to bias the swingable lever away from the switch. A second biasing member is provided to bias the actuation member away from the in a direction lever.

In yet another aspect, the switch actuation section of the swingable lever presses a leading end of a lever-shaped actuator disposed in the switch.

In yet another aspect, a virtual line extending through a swinging or rotational shaft center of the supporting member and that of the swingable lever is substantially orthogonal to a longitudinal axis of the lever-shaped actuator.

In yet another aspect, the supporting member and the switch collectively form a single structure.

In yet another aspect, the supporting member, the actuation member, and the switch collectively form a single structure.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF PREFERRED EMBODIMENTS

Figure 1:
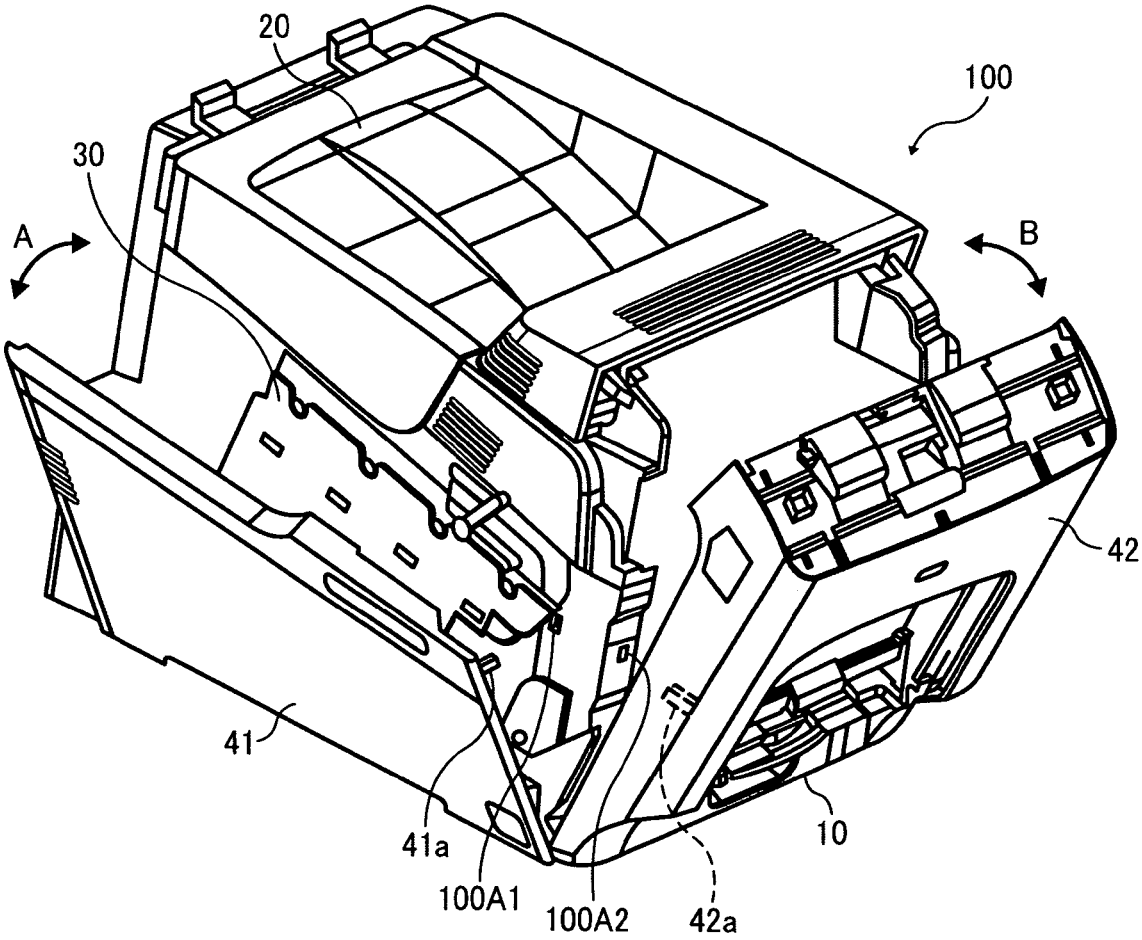
FIG. 1 is a perspective view illustrating an image forming apparatus that includes an exemplary switch actuation device according to one embodiment of the present invention.

Referring now to the drawings, wherein like reference numerals and characters designate identical or corresponding parts throughout the several figures, and in particular in FIG. 1, an image forming apparatus 100 includes a sheet feeding section 10 having plural sheet feeding cassettes each accommodating recording medias, a sheet ejection section 20 stacking recording medias each bearing an image, and an image formation section forming an image on a recording media. The image formation section 30 is disposed between the sheet feeding section 10 and the sheet ejection section 20. An image formed by the image formation section 30 is transferred onto a recording sheet conveyed from the sheet feeding section 10. The recording sheet is then ejected onto the sheet ejection section 20.

Openably closable left and front side covers 41 and 42 on respective left side and front side surfaces of a housing of the image formation section 30 are swingable in directions shown by arrows A and B around their lower sections for the purposes of allowing access to the interior of the image forming apparatus 100 for replacing a developing device with a new one when a prescribed numbers of sheets has been printed and a life of a device ends, or when removing a jammed recording media during printing. Further, there are disposed plural protrusions 41*a* and 42*a* on the both left and front side covers 41 and 42 while protruding therefrom toward an inside of the housing to serve as links linked with opening and closing of the covers 41 and 42, respectively.

Specifically, the protrusion 41*a* is disposed on an inner surface of the left side cover 41 almost at a right side end thereof, whereas the protrusion 42*a* is disposed approximately centrally along one side end of the front cover 42; in the present embodiment, that side is the left side. Plural openings 100A1 and 100A2 are disposed on sections of the housing facing the respective protrusions 41*a* and 42*a*, in to which the protrusions 41*a* and 42*a* are inserted.

The opening 100A1 is formed on the left side surface almost at the corner between the front and left side surfaces. The switch actuation device described later is provided in an inner space surrounded by the openings 100A1 and 100A2.

When a developing device is replaced with a new one, the left side cover 41 is opened. When a jammed recording sheet is extracted, the front cover 42 is opened. There is a section in the interior of the image forming apparatus 100 to which a high voltage is applied such as when a toner image is transferred onto a recording sheet or when a recording sheet is conveyed. For this reason, when one of the left and front covers 41 and 42 is opened, the above-described switch actuation device is activated and a power supply is turned off to shut off the high-voltage section.

Figure 2:
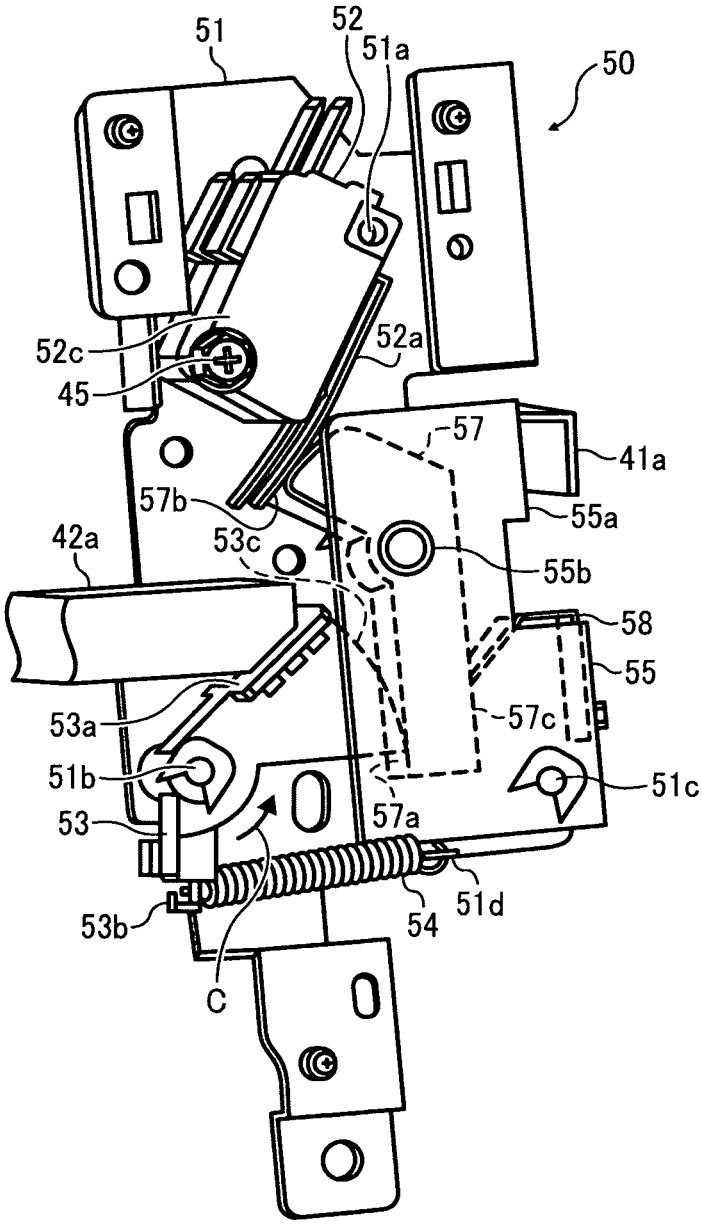
FIG. 2 is a perspective view illustrating the switch actuation device of FIG. 1.
Figure 3:
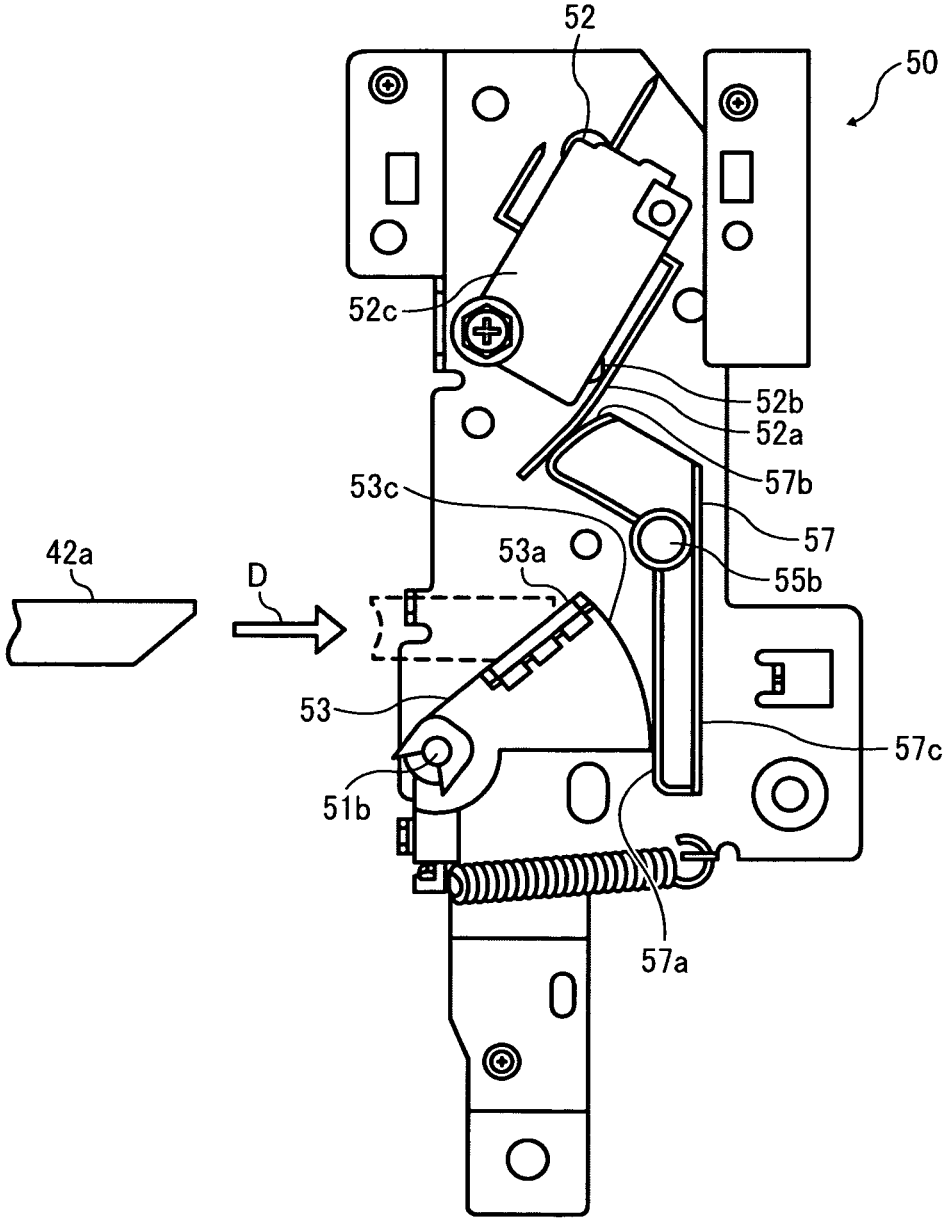
FIG. 3 is a front view illustrating the switch actuation device of FIG. 1.

As shown in FIG. 2, the switch actuation device is viewed from an inside of the housing of the image forming apparatus 100. As shown in FIG. 3, the switch actuation device is viewed without a swingable bracket 55. As shown in FIGS. 2 and 3, both left and front covers 41 and 42 are closed and accordingly a switch of the switch actuation device 50 is turned on.

As shown in FIGS. 2 and 3, the switch actuation device 50 includes a holding bracket 51 as a single structure that holds respective members. The holding bracket includes three shafts 51*a* to 51*c*. A micro-switch 52 is screwed to the shaft 51*a* by a screw 45. An actuation member 53 is disposed against the shaft 51*b* using an E-shaped ring and is rotatable therearound. Further, a swingable bracket 55 is disposed against the shaft 51*c* as a supporting member using an E-shaped ring and is swingable therearound.

The micro-switch 52 mainly includes an actuator unit that has a hinge lever 52*a* and an actuation element 52*b*, and a housing 52*c* that has a spring as a biasing member that biases an electric contact point and the actuation element 52*b* in a prescribed direction.

Figure 4:
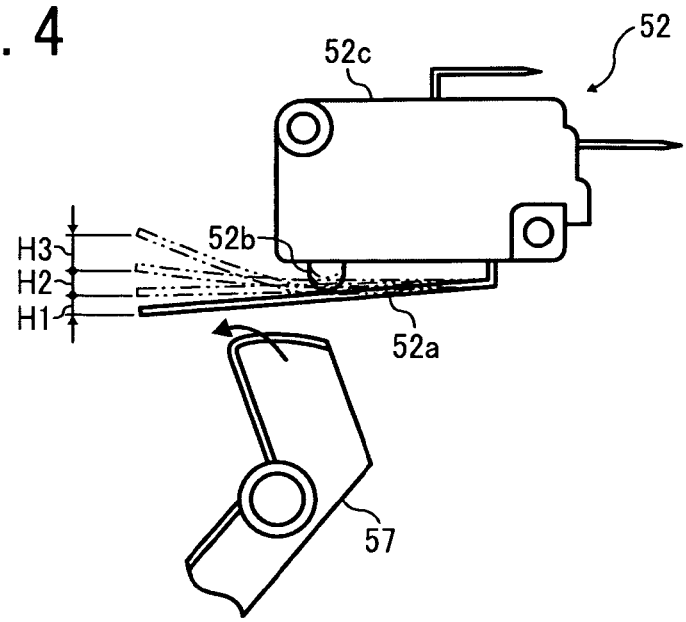
FIG. 4 is an exemplary micro-switch operating in the switch actuation device of FIG. 1.

Now, the micro-switch 52 is described in more in detail with reference to FIG. 4 illustrating a front view thereof when the housing lies horizontally. The micro-switch 52 is a normal open type, which is electrically turned off when the hinge lever 52*a* is free from activation. The hinge lever 52*a* is produced by a flexible thin plate with its one end being disposed against the housing and with its other end being free. Further, the actuation element 52*b* is biased downward in the drawing by a spring disposed in the housing, so that the leading end thereof contacts the hinge lever 52*a* to push the hinge lever 52*a* down when the hinge lever 52*a* is free from a load. Further, the actuation element 52*b* is enabled to step back within the housing against the bias force of the spring and turns on a contact point disposed in the housing when a free end of the hinge lever 52*a* receives load and is lifted up.

When the lever 57 described later swings in a direction shown by an arrow in the drawing and contacts the free end of the hinge lever 52*a*, the hinge lever 52*a* gradually rises around its fixed end as a fulcrum due to a pressing force of the lever 57, and presses the actuation element 52*b* at the same time. Since the micro-switch 52 includes a mechanical allowance H1, the contact point is not immediately turned on even when the lever 57 contacts the hinge lever 52*a*. However, when the lever 57 swings beyond the mechanical allowance H1, the actuation element 52*b* linked with the hinge lever 52*a* turns the contact point on in the housing. Even when the lever 57 lifts the hinge lever 52*a* up from the above-described situation, respective parts of the micro-switch 52 are not overloaded as far as it stays within the appropriate operation ranged H2. However, when the free end of the hinge lever 52*a* is lifted up higher than the horizontal line in the drawing, the contact point maintains the turning on condition, but the hinge lever 52*a* is bent, so that the actuation element 52*b*, the inner spring, and the inner contact point are overloaded (see a range of H3 in the drawing).

Durability of the micro-switch is excellent in general. However, when the micro-switch is continuously overloaded for a long time, the hinge lever 52*a* is sometimes permanently deformed. In addition, the actuation element 52*b*, the inner spring, and the inner contact point are damaged, thereby the micro-switch is broken. To resolve such a problem, when the micro-switch 52 is activated, the lever 57 is preferably stopped so that the hinge lever 52*a* of the micro-switch 52 operates within the appropriate operation range H2.

Figure 5:
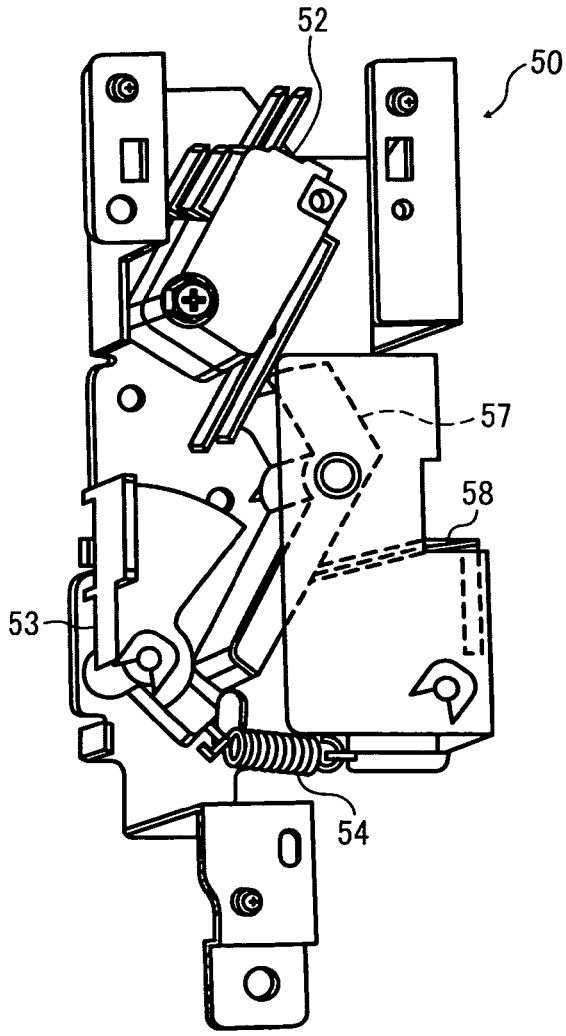
FIG. 5 is the switch actuation device of FIG. 1 operating when a front cover is opened.

As shown in FIG. 2, the actuation member 53 includes a reception surface 53*a* that contacts the protrusion 42*a* of the front cover 42, and an engaging section 53*b* on an opposite side of the shaft 51*b* to the reception surface 53*a*, which engages one end of the spring 54. The protrusion 42*a* inserted through the opening 100A2 of the housing contacts the reception surface 53*a* when the front cover 42 is closed. Thus, the actuation member 53 swings against a bias force of the spring 54 while receiving a pressing force from the protrusion 42*a*. The spring 54 is a tension spring with the other end of it being held by the spring holder 51*d* of the holder bracket 51. Since the actuation member 53 is always biased by the spring 54 in a direction shown by an arrow C, the reception surface 53*a* swings to a vertical position when the front cover 42 is opened and the protrusion 42*a* is withdrawn as shown in FIG. 5. Further, the contact section 53*c* contacting the lever 57 at the end of the actuation member 53 is constituted by an arc shaped cam rotating around the shaft 51*b*. Thus, when the actuation member 53 swings receiving the pressing force from the protrusion 42*a*, the contact section 53*c* contacts the reception surface 57*a* of the lever 57 serving as an actuation object section, and causes swinging of the lever 57.

The swingable bracket 55 includes a reception surface 55*a* contacting the protrusion 41*a* of the left side cover 41. When the left side cover 41 is closed, the protrusion 41*a* is inserted through the opening 100A1 of the housing and contacts the reception surface 55*a* of the holder bracket 51 due to the pressing force. Further, a shaft 55*b* swingably supporting the lever 57 and a plate spring 58 that biases the lever 57 are disposed in the swingable bracket 55.

The ends of the lever 57 are swingble around the shaft 55*b* of the swingable bracket 55. The pressing section 57*b* serving as a switch actuation section at one end of the lever 57 faces the hinge lever 52*a* of the micro-switch 52. A left side surface of the actuation object section (i.e., a rear end) of the actuation member 53 faces the contact section 53*c* at its other end. The lever 57 includes a reception surface 57*a* serving as the actuation object section which contacts the contact section 53*c* of the actuation member 53, a pressing section 57*b* that contacts the hinge lever 52*a* of the switch 52, and a spring reception surface 57*c* that receives a bias from the plate spring 58. Thus, when the contact section 53*c* of the actuation member 53 contacts the reception surface 57*a* serving as the actuation object section, the lever 57 swings due to the pressing force so that the pressing section 57*b* of the leading end approaches the hinge lever 52*a*, while the switch 52 is turned on when the hinge lever 52*a* is pressed. In this way, the lever 57 swings together with the swingable bracket 55 being held thereon, while the lever itself swings around the shaft 55*b* of the swingable bracket 55.

One end of the plate spring 58 is disposed against the swingable bracket 55 with its free end always contacting the spring reception surface 57*c* of the lever 57. Thus, the leading end section of the lever 57 is biased in a direction to separate away from the micro-switch 52, i.e., a direction in which the pressing section 57*b* of the lever 57 is separated from the hinge lever 52*a*.

In the above-described switch actuation device 50, when the left side cover 41 is closed, the protrusion 41*a* contacts the reception surface 55*a* of the swingable bracket 55, and accordingly, both the swingable bracket 55 and the lever 57 swing together toward the micro-switch 52. In such a situation, since the pressing section 57*b* of the lever 57 held by the swingable bracket 55 is located at a position separated from the hinge lever 52*a* of the switch 52 due to the bias force of the plate spring 58, the micro-switch 52 is continuously turned off as shown in FIG. 5. In such a situation, when the front cover 42 is further closed, the protrusion 42*a* moves in a direction shown by an arrow D in the drawing, and contacts and presses the reception surface 53*a* of the actuation member 53. Further, the actuation member 53 swings against the bias force of the spring 54. Then, the contact section 53*c* contacts the reception surface 57*a* of the lever 57, and the lever 57 swings in a prescribed direction. Consequently, the pressing section 57*b* of the lever 57 presses the hinge lever 52*a* of the micro-switch 52, thereby turning on the micro-switch 52. In this way, when the left and front side covers 41 and 42 are closed at the same time, the micro-switch 52 is turned on, so that power can be supplied to the image forming apparatus.

Now, an exemplary operation of the switch actuation device 50 when a front cover is opened is described with reference to FIG. 5. As shown, when the front cover 42 is opened, the protrusion 42*a* is withdrawn. Simultaneously, the actuation member 53 is drawn by the spring 54 and swings in a direction to separate away from the lever 57. At that moment, since the lever 57 is biased by the plate spring 58 in a direction to separate away from the micro-switch 52, the pressing section 57*b* of the lever 57 separates from the hinge lever 52*a* of the switch 52. Consequently, even when the front cover 42 is opened while the left cover 41 is closed, the micro-switch 52 is turned off.

Figure 6:
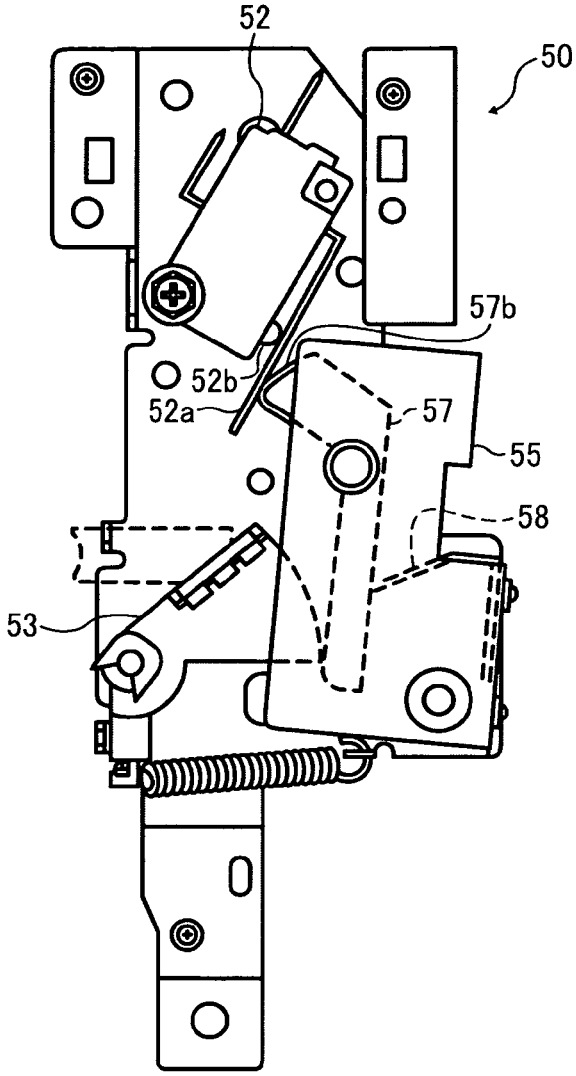
FIG. 6 is the switch actuation device of FIG. 1 operating when a left side cover is opened.

Now, an exemplary operation of the switch actuation device 50 when the left cover is opened is described with reference to FIG. 6. When the left cover 41 is opened, the protrusion 41*a*, not shown, is withdrawn. Simultaneously, the pressing force applied to the pressing section 57*b* of the lever 57 via the bracket 55 by the protrusion 41*a* to press the hinge lever 52*a* of the switch 52 is released, and the lever 57 is pressed and returned by a reacting force of the hinge lever 52*a*, so that the micro-switch 52 is turned off. At this moment, since the actuation member 53 engages the reception surface 53*a* of the other end of the lever 57, the lever 57 substantially does not swings with regard to the swinging bracket 55, but swings in a direction to separate away from the hinge lever 52*a* together with the swinging bracket 55. Consequently, when the left side cover 41 is opened, the micro-switch 52 is turned off even if the front cover 42 is closed.

According to one embodiment of the present invention as described above with reference to FIGS. 1 to 6, the micro-switch 52 is turned off when one of left and front side covers is opened, and is turned off only when both are closed.

Further, the switch actuation device of the above-described embodiment can achieve a stable operation regardless of fluctuation in movement amounts of the protrusions 41*a* and 42*a*, which are caused by fluctuation in opening and closing amounts of the left and front side covers 41 and 42, and that in positions and shapes of the members.

Now, a situation when the front cover 42 is closed and the protrusion 42*a* stops largely passing through a prescribed position is described with reference to FIG. 3. In such a situation, even though a swinging amount of the actuation member 53 increases, a swinging amount of the lever 57 caused by pressing of the actuation member 53 does not fluctuate, because the contact section 53*c* contacting the lever 57 of the actuation member 53 is constituted by an arc shaped cam having a center at a shaft 51*b*. Specifically, even when a closing position of the front cover 42 fluctuates, and accordingly a swinging angle of the actuation member 53 fluctuates, the swinging amount of the lever 57 substantially does not fluctuate. However, since fluctuation in cam shapes of the contact section 53*c* of the lever 53, and that in shapes of the reception surface 57*a* of the lever 57 that contacts the actuation member 53 remain, the swinging angle of the lever 57 is hardly limited perfectly within a prescribed level.

Then, the pressing section 57*b* of the leading end of the lever 57 that contacts the hinge lever 52*a* of the micro-switch 52 is constituted by an arc shaped cam having a center at a shaft 55*b* of the support bracket 55. Consequently, even when the lever 57 excessively swings more than a prescribed angle, a pressing amount of the lever 57 pressing the hinge lever 52*a* does not largely fluctuate, and the micro-switch 52 can avoid overload.

Further, since the pressing section 57*b* of the lever 57 faces a leading end of the hinge lever 52*a*, the hinge lever 57 elastically deforms, and accordingly load on the micro-switch 52 can be reduced even when a pressing-in amount increases due to fluctuation in shapes of the lever 57.

Figure 7:
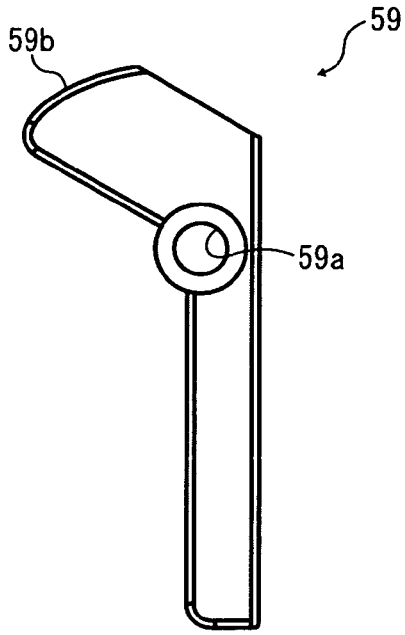
FIG. 7 is a front view of another exemplary lever.

Instead of the above-described arc shaped cam of the lever 57, a lever 59 having a cam shape as shown in FIG. 7 can be employed. Specifically, a pressing section 59*b* of the lever 59 which contacts the hinge lever 52*a* of the micro-switch 52 does not form an arc shape having a swinging center at a shaft hole 59*a*, and an amount of pressing the hinge lever 52*a* is changed in accordance with a rotational angle of the lever 59. Specifically, a radius starting from a rotation center of the shaft hole 59*a* ending at a leading end of the pressing section is smaller on the right side end than that on the left side end. Consequently, as the swinging angle of the lever 59 increases contacting the hinge lever 52*a*, a pressing amount gradually decreases and does not increase even when the lever 59 swings more than a supposed level in comparison with the lever 57.

Figure 8:
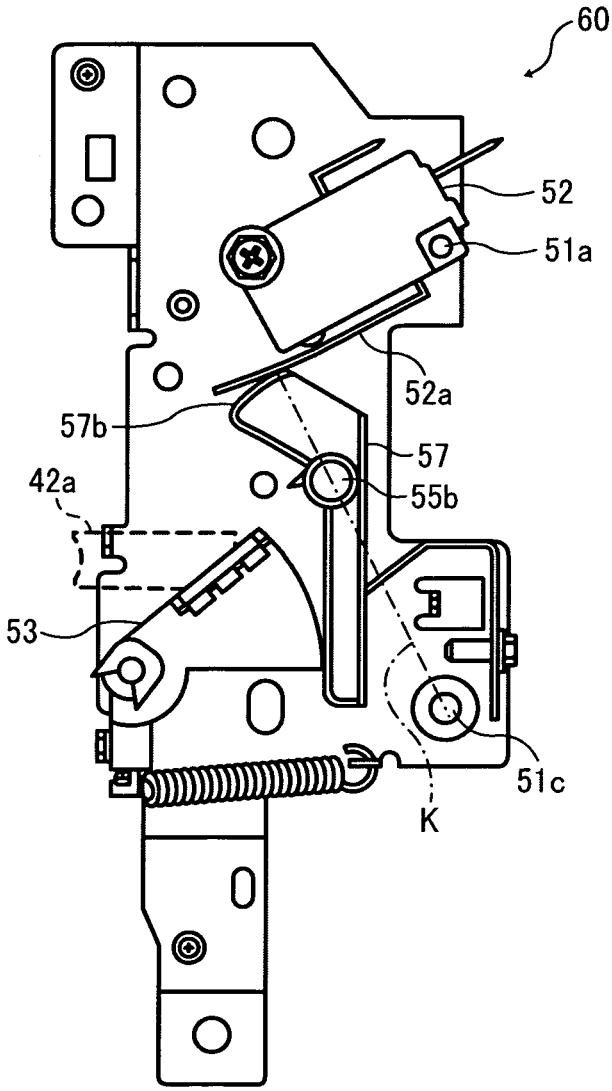
FIG. 8 is a front view of another exemplary switch actuation device according to another embodiment of the present invention.

Now, another embodiment of the switch actuation device 60 is described with reference to FIG. 8. As shown, a micro-switch 52 is disposed at a prescribed position enabling to highly likely avoid overload thereon.

Specifically, a positional relation between the lever 57 and the micro-switch 52 in the switch actuation device 60 is different from that in the switch actuation device 50. For example, the micro-switch 52 is positioned so that a virtual line extending through a center of the shaft 51*c* serving as swinging center for the swinging bracket 55 and a center of the shaft 55*b* serving as swinging center for the lever 57 orthogonally intersects with the hinge lever 52*a* of the micro-switch 52 when the protrusion 41*a* causes swinging of bracket 55. Consequently, even when the swinging angle of the swinging bracket 55 around the shaft 51*c* fluctuates due to the fluctuation in stopping positions and shapes of the protrusion 41*a*, the pressing section 57*b* formed on the leading end of the lever 57 swingably supported by the swinging bracket 55 contacts the hinge lever 52*a*, and the fluctuation in amounts of pressing toward the hinge lever 52*a* can be suppressed to the minimum level. When the micro-switch 52 is turned on and a swinging angle of the bracket 55 is too large for the virtual line K to orthogonally intersect with the hinge lever 52*a* (making a sharp angle), the pressing section 57*b* formed on the leading end of the lever 57 moves in a direction to separate away from the hinge lever 52*a*, so that an amount of pressing toward the hinge lever 52*a* by the lever 57 decreases. Specifically, the maximum value of the pressing-in amount toward the hinge lever 52*a* is determined by a distant between centers of the shafts 51*c* and 55*b* and that between the center of the shaft 55*b* and the pressing section 57*b* of the lever 57. Thus, as the swinging angle of the swinging bracket 55 deviates from a prescribed angle, the pressing amount decreases.

Since the pressing section 57*b* of the leading end of the lever 57 is constituted by the arc shaped cam having the center at the shaft 55*b*, the pressing amount with regard to the hinge lever 52*a* substantially does not fluctuate even when the moving amount of the protrusion 42*a*, and the swinging angle of the actuation member 53 and the lever 57 fluctuate.

Further, according to the switch actuation device 60, even when the moving amount of the protrusion 41*a* and the swinging angle of the actuation member 55 fluctuate, the amount of pressing-in of the lever 57 toward the hinge lever 52*a* can be suppressed to the minimum level, and accordingly a stable operation of the micro-switch 52 can be obtained while avoiding the overload thereon. Further, even when the moving amount of the protrusion 42*a*, and the swinging angles of the actuation member 53 and the lever 57 fluctuate, the pressing amount with regard to the hinge 52 substantially does not fluctuate, and accordingly a stable operation of the micro-switch 52 can be obtained while avoiding the overload thereon.

Obviously, numerous additional modifications and variations of the present invention are possible in light of the above teachings. It is therefore to be understood that within the scope of the appended claims, the present invention may be practiced otherwise than as specifically described herein.

What is claimed is:

1. A switch actuation device for turning on and off a switch in accordance with one of movement and rotation of at least two movable members, said switch actuation device comprising:

a first shaft;

a supporting member swingably or rotatably disposed around the first shaft in response to movement or rotation of a first one of the at least two movable members;

a second shaft supported by the supporting member; and a swingable lever supported by the second shaft with its both ends being swingable, one of said both ends including a switch actuation section to activate the switch, said swingable lever swinging around the second shaft in response to movement or rotation of a second one of the at least two movable members, wherein said switch actuation section of the swingable lever activates the switch when the supporting member and the swingable lever swing at the same time and in opposite direction in response to the movement or the rotation of the first and second one of the at least two movable members, respectively, and wherein said switch actuation section of the swingable lever includes a cam.

2. The switch actuation device as claimed in claim 1, wherein said cam includes an arc-shaped portion disposed facing the switch.

3. The switch actuation device as claimed in claim 1, further comprising:

a third shaft; and an actuation member supported by the third shaft to either swing or rotate around the third shaft, said actuation member presses an actuation object section disposed at an opposite side to the switch actuation section of the swingable lever at its one end;

wherein said actuation member swings or rotates in response to the movement or the rotation of a second one of the at least two movable members, and presses the actuation object section of the swingable lever in a prescribed direction so that the switch actuation section of the swingable lever presses and activates the switch.

4. The switch actuation device as claimed in claim 1, wherein said switch includes a lever-shaped actuator to turn on the switch when pressed, and wherein said switch actuation section of the swingable lever presses a leading end of the lever-shaped actuator.

5. The switch actuation device as claimed in claim 1, wherein the switch is formed on the supporting member.

6. The switch actuation device as claimed in claim 3, wherein said actuation member includes a cam at the one end.

7. The switch actuation device as claimed in claim 3, further comprising:

a first biasing member to bias the swingable lever away from the switch; and a second biasing member to bias the actuation member away from the swingable lever.

8. The switch actuation device as claimed in claim 3, wherein the actuation member and the switch are formed on the supporting member.

9. The switch actuation device as claimed in claim 4, wherein a virtual line extending through a swinging or rotational center of the supporting member of the first shaft and that of the swingable lever of the second shaft is substantially orthogonal to a longitudinal axis of the lever-shaped actuator.

10. The switch actuation device as claimed in claim 6, wherein said cam includes an arc-shaped portion disposed facing the actuation object section of the swingable lever.

11. An interlock mechanism including the switch actuation device as claimed in claim 1.

12. The interlock mechanism as claimed in claim 11, wherein said at least two movable members each at least includes an openably closable cover.

13. The interlock mechanism as claimed in claim 11, further including:

a first link to transmit movement or rotational motion of the first one of the at least two movable members to the supporting member; and a second link to transmit movement or rotational motion of the second one of the at least two movable members to the actuation member.

14. An image forming apparatus including the interlock mechanism as claimed in claim 11.

* * * * *